United States Patent [19]

Toub et al.

[11] Patent Number: 4,625,523

[45] Date of Patent: Dec. 2, 1986

[54] OIL COLLECTION/RECIRCULATION FOR VAPOR-COMPRESSION REFRIGERATION SYSTEM

[76] Inventors: Samuel G. Toub, 14114 Dallas Pkwy./Suite 470, Dallas, Tex. 75240; James L. Gilliland, Jr.; Homer W. Holder, both of 3614 Security, Garland, Tex. 75042

[21] Appl. No.: 700,705

[22] Filed: Jan. 25, 1985

Related U.S. Application Data

[62] Division of Ser. No. 375,721, May 7, 1982, Pat. No. 4,534,182.

[51] Int. Cl.[4] ..... F25B 31/00

[52] U.S. Cl. ..... 62/193; 62/471

[58] Field of Search ..... 62/83, 471, 192, 193, 62/524, 472, 84

[56] References Cited

U.S. PATENT DOCUMENTS 1,866,992 7/1932 Zieber ..... 62/524 X 3,257,824 6/1966 Shikasho ..... 62/83 X 3,494,137 2/1970 Cargo ..... 62/192 X

*Primary Examiner*—William E. Wayner

*Attorney, Agent, or Firm*—Kenneth R. Glaser

[57] ABSTRACT

A single or multiple evaporator vapor-compression refrigerant system for single or multi-story structures includes a lubricating oil collection reservoir and a separate oil pumping unit for returning oil separated from the refrigerant fluid in the refrigerant flow circuit to the compressor unit. In multi-story, direct expansion, vapor-compression, air conditioning systems, a simplified generally vertical refrigerant vapor return riser is provided with an oil reservoir at the lowest elevation point of the riser and a liquid level sensing switch for energizing and deenergizing the separate lubricating oil pumping unit. The pumping unit may include an electric or refrigerant fluid driven motor connected to a pump or the pumping unit may include a pressure vessel into which high pressure refrigerant vapor is admitted to displace oil back to the compressor through an oil return conduit.

7 Claims, 6 Drawing Figures

OIL COLLECTION/RECIRCULATION FOR VAPOR-COMPRESSION REFRIGERATION SYSTEM

This is a division of application Ser. No. 06/375,721, filed 5/7/82, now U.S. Pat. No. 4,534,182.

BACKGROUND OF THE INVENTION

1. Field of the Invention

The present invention pertains to a vapor-compression refrigeration system particularly adapted for multi-story buildings wherein the compressor lubricating and/or cooling oil separated from the refrigerant fluid downstream of the compressor is collected at the base of a refrigerant vapor return riser and recirculated to the compressor by an automatically controlled oil pumping system.

2. Background Art

In the art of refrigeration and air conditioning systems for single and multi-story buildings and other structures, the use of vapor-compression systems with direct expansion of the refrigerant to evaporator or cooling units at various levels within the building has become particularly attractive due to overall economy of installation and superior performance. In the installation of vapor-compression refrigeration systems it has substantially always been a problem to deal with quantities of compressor lubricating and/or cooling oil which inevitably become entrained with the refrigerant fluid being discharged from the compressor. Even with oil separation devices interposed in the compressor discharge line at least minute quantities of oil remain entrained with the refrigerant fluid and, over long periods of time, collect in the system piping throughout the refrigerant circuit—including in particular, the refrigerant vapor return line from the evaporator to the compressor inlet. This oil must be recirculated back to the compressor in order to prevent unwanted accumulation in the refrigerant lines, and in installations involving substantial line length, it is important to be able to continuously recirculate the lubricating oil back to the compressor in order to minimize the total quantity of oil needed for compressor lubrication and/or cooling.

Providing for the recirculation of oil entrained in the refrigerant flow circuit of vapor-compression air conditioning systems in multistory buildings has been a particularly vexatious problem and has been dealt with to some extent in prior art installations by providing complex refrigerant vapor return riser systems leading from the evaporator units to the roof mounted compressor and condensing unit and which have oil traps disposed at various elevations throughout the length of the return risers. By providing oil traps in the form of reverse bends in the return risers, the oil is allowed to collect in the traps until the velocity of the refrigerant vapor flowing through the risers is sufficient to entrain the oil, carry it upwardly to the next trap, and so on until the oil is returned to the compressor unit. The complex and expensive plumbing arrangement of prior art refrigerant return risers not only makes this method of oil return expensive, but as a practical matter, the overall vertical elevation for which vapor-compression refrigeration systems may be utilized with direct expansion to the evaporator or cooling coil units at various levels has been limited to approximately four stories or 45–50 feet in overall elevation.

Moreover, the sizing of the refrigerant vapor return riser which is required to maintain sufficient gas velocity to entrain the liquid oil has been such that pressure losses in the system require greater compressor power input for a given performance level of the refrigeration system.

A still further problem with prior art refrigeration or air conditioning systems for multi-story buildings wherein the aforementioned type of refrigerant return riser is utilized pertains to maintaining sufficient velocity of the refrigerant vapor at reduced load conditions. In this regard, it has been necessary in many installations to provide secondary refrigerant vapor return lines which bypass the main riser oil traps so that return flow of refrigerant fluid is possible at reduced operating load and refrigerant fluid flow conditions. Secondary return risers have compounded the problems associated with the cost and complexity of vapor-compression refrigeration systems installed in multi-story as well as single story buildings and other installations. However, in accordance with the present invention, the complex and expensive piping systems of prior art direct expansion vapor-compression refrigeration or air conditioning systems have been eliminated with an improved arrangement of the refrigerant vapor return riser system and a unique method and apparatus for returning oil which separates from the refrigerant as it flows through the circuit from the evaporator back to the compressor.

SUMMARY OF THE INVENTION

The present invention provides an improved oil collection and return system for use in conjunction with vapor-compression type refrigeration and air conditioning systems wherein the complex plumbing of the refrigerant return lines from the evaporator or cooling units has been eliminated and replaced with a simplified return riser or manifold and a separate oil return circuit. In accordance with one aspect of the present invention, there is provided a vapor-compression air conditioning system for multi-story buildings and the like wherein one or more evaporator units may be mounted at an elevation substantially below the compressor and condensing unit and wherein a simplified and relatively large diameter refrigerant return conduit may be provided without the requirement for several vertically spaced apart oil collection traps or the secondary vapor return risers bypassing the oil traps.

In accordance with another aspect of the present invention, there is provided an oil return system for collecting and recirculating liquid oil which collects throughout the refrigerant flow circuit and normally settles in the conduit system at points of low elevation. The system is comprised of a separate oil recirculating system which may be automatically controlled to permit only minimum oil accumulation in a sump portion of a refrigerant return riser. The provision of an automatically controlled motor driven pump or a pumping circuit using refrigerant vapor under pressure for pumping the liquid oil from a low level sump or reservoir to a suitable return point at or adjacent to the compressor inlet utilizes considerably less energy than is required for prior art vapor-compression refrigeration systems.

In accordance with yet another aspect of the present invention, there is provided an oil return system for a vapor-compression refrigeration system wherein a single common refrigerant vapor return line or riser may be provided without complex and expensive fittings required of prior art risers and which riser may serve as a return manifold for one or more evaporator units disposed at various levels throughout a multi-story building and the like. With the oil return system of the present invention, the overall building height in which vapor-compression direct expansion air conditioning systems may be used is no longer limited to the extent of prior art systems.

In accordance with yet a further aspect of the present invention, there is provided an oil return system for collecting and recirculating oil from a vapor-compression refrigeration unit wherein a sump is provided in the base of a vertical refrigerant return line or riser. The sump is connected to an oil level sensing switch arrangement for energizing and deenergizing a motor driven oil pump or a solenoid operated valve arrangement for controlling a pressure fluid pumping circuit to permit only a minimum accumulation of oil in the collecting sump. The oil collecting and return system may include a high oil level warning device and may also be arranged to automatically shut down the air conditioning compressor units if a predetermined maximum accumulation of oil is exceeded.

The present invention still further provides an oil return system for a vapor-compression refrigeration unit wherein refrigerant fluid is utilized to pump oil collected from the refrigerant flow lines to the refrigerant compressor. In one embodiment of the present invention, a fluid operated motor-pump unit advantageously utilizes refrigerant fluid from the vapor-compression refrigeration system itself to drive a motor under automatic control in accordance with the level of oil collecting in a sump or reservoir. In other embodiments of the invention, refrigerant vapor is automatically valved directly to a pressure vessel or reservoir containing accumulated oil for forcing the oil back to the refrigerant compressor.

Those skilled in the art will recognize further superior features and advantages of the present invention upon reading the detailed description which follows in conjunction with the drawings.

DESCRIPTION OF THE PREFERRED EMBODIMENTS

Figure 1:
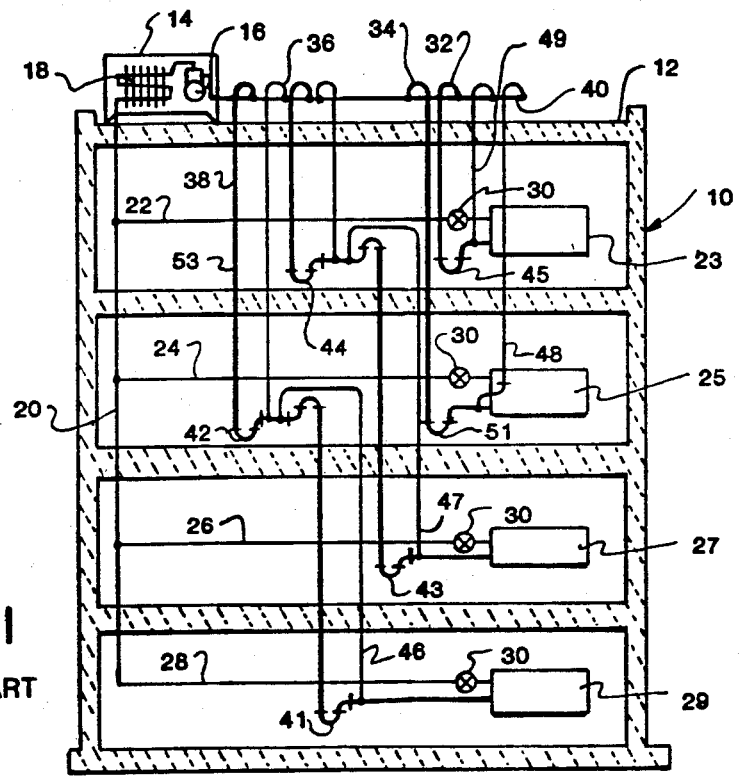
FIG 1 PRIOR ART
FIG. 1 is a schematic diagram illustrating a typical prior art vapor-compression air conditioning system for a multi-story building.

In the description which follows, like parts are indicated throughout the description and drawings with the same reference numerals, respectively. The drawings are not to scale and certain features of the invention are shown in schematic form in the interest of clarity and conciseness.

Referring to FIG. 1, there is illustrated in schematic form the arrangement of a typical prior art vapor-compression, direct expansion air conditioning system for a multi-story building designated by the numeral 10. The building 10 is indicated as having four floor levels or being four stories in height and includes a roof 12 on which a compressor and condensing unit 14 for a vapor-compression type refrigeration system is mounted. The condensing unit 14 includes a motor driven compressor 16 and an air cooled condenser 18. The refrigerant discharge line from the condenser 18 is indicated generally by the numeral 20 and includes branch lines 22, 24, 26 and 28 leading to respective evaporator units designated by the numerals 23, 25, 27 and 29. Each of the branch refrigerant fluid delivery lines for conducting liquid refrigerant is provided with an expansion valve indicated by the numeral 30 whereby the liquid refrigerant entering each of the respective evaporator units is allowed to flash to a vapor state after entering the evaporators to absorb heat from a source such as air being circulated through each level of the building 10. Each of the evaporator units 23, 25, 27 and 29 is provided with a main refrigerant vapor return line or riser designated by the respective numerals 32, 34, 36 and 38. The refrigerant vapor return risers 32, 34, 36 and 38 are connected to a common header or manifold, generally designated by the numeral 40.

As indicated previously herein, conventional vapor-compression refrigeration units utilizing reciprocating as well as rotary type compressors must live with a certain amount of compressor lubricating and/or cooling oil entrained with the refrigerant discharged from the compressor and conducted through the refrigerant flow circuit including the condenser, the refrigerant liquid delivery lines to each evaporator, and the refrigerant vapor return or compressor suction line. Continuous use of a system such as that illustrated schematically in FIG. 1 results in the eventual circulation and accumulation of oil throughout the refrigerant flow circuit; thus, the oil tends to flow to a location in the circuit at a low elevation due to the force of gravity.

In accordance with a system as illustrated in FIG. 1, the return of lubricating oil to the compressor is provided by entrainment of the oil with the refrigerant vapor flowing through the respective return risers 32, 34, 36 and 38. In order to provide sufficient velocity of the refrigerant vapor flowing from the respective evaporators through the return risers to the compressor, the risers are provided with a series of reverse bends or oil traps such as the traps 41 and 42 in the riser 38. Due to the vertical elevation of evaporator 27 with respect to the compressor unit 14, the riser 36 is also provided with two traps 43 and 44. Conventional practice requires that a trap or bend be installed at approximately 20 ft. intervals of vertical elevation. Accordingly, the risers 32 and 34 may only require one trap 45 and 51, respectively. As the oil accumulates in the traps or bends in the respective risers and accumulates to a certain level, the effective flow area for the refrigerant vapor is reduced and the velocity of refrigerant flowing through the bend increases to the point that some of the oil is entrained with the refrigerant vapor flowing upward. Through successive stages of lift as provided by the spaced apart traps illustrated in FIG. 1, the oil is eventually returned to the compressor inlet. In conventional reciprocating compressors, the refrigerant return flow is normally conducted through a hermetically sealed motor housing before entering the compressor cylinders wherein substantially all of the entrained oil is separated out and flows to a sump or crankcase for eventual circulation by the compressor lubricant circuit. In compressors where oil is mixed with the refrigerant vapor in the compression chamber, there is usually no concern for separation of the entrained oil before it enters the compressor proper.

The requirement for the series of reverse bends and traps as illustrated in the schematic diagram of FIG. 1 is not cost effective. The additional cost of the numerous pipe or conduit fittings required as well as the additional labor required to plumb up the system are disadvantageous. Moreover, the method of relying on liquid entrainment by increasing the velocity of the refrigerant vapor flow through the return riser results in flow losses in the system which require more compressor power than would be necessary if the need for flow restriction in order to increase refrigerant flow velocity were not present. Furthermore, as illustrated in FIG. 1, when a multi-story or multi-evaporator system is operating at part load or when less than all of the evaporators are operating at substantial refrigerant flow rates, the flow of refrigerant in the return circuit will not be sufficient to entrain oil accumulated in one or more of the traps. In order to overcome this problem, the system must be provided with secondary return risers for each evaporator circuit as indicated by the respective numerals 46, 47, 48, 49, 53 and 55. For example, if the evaporator 29 is the only unit operating and/or is operating at part load, the flow of refrigerant in the return riser 38 may not be sufficient to overcome the blockage in the traps 41 or 42 formed by an accumulation of oil without increasing the back pressure in the evaporator to the point where the system is not operating efficiently. Under these conditions, the return risers 46 or 53 allow the return flow of refrigerant to the compressor for recompression, condensation and circulation back through the expansion valve 30 associated with the evaporator 29. Under such an operating mode, oil entrained in the refrigerant flowing through the evaporator 29 tends to accumulate even more so in the trap 41, or in the case of part load operation of only one of the other evaporator units, oil also tends to accumulate in the respective traps associated with each of such units.

As will be appreciated from the foregoing description and the schematic diagram of FIG. 1, prior art refrigeration systems for multi-story structures, wherein the return flow from the various evaporator units must be elevated, have resulted in relatively complex system plumbing. Moreover, the overall height of the structure from the lowermost evaporator unit to the compressor/condenser unit is limited with such a system unless multiple traps are provided at closely spaced intervals as illustrated in the schematic diagram of FIG. 1. However, in accordance with the present invention as illustrated schematically in FIGS. 2 through 6, an improved vapor-compression refrigeration system has been developed which requires a greatly simplified piping network, is not limited to a particular maximum elevation between the lowest evaporator unit and the roof mounted or higher elevation mounted compressor and condenser unit, and results in lower energy consumption for a given performance requirement.

Figure 2:
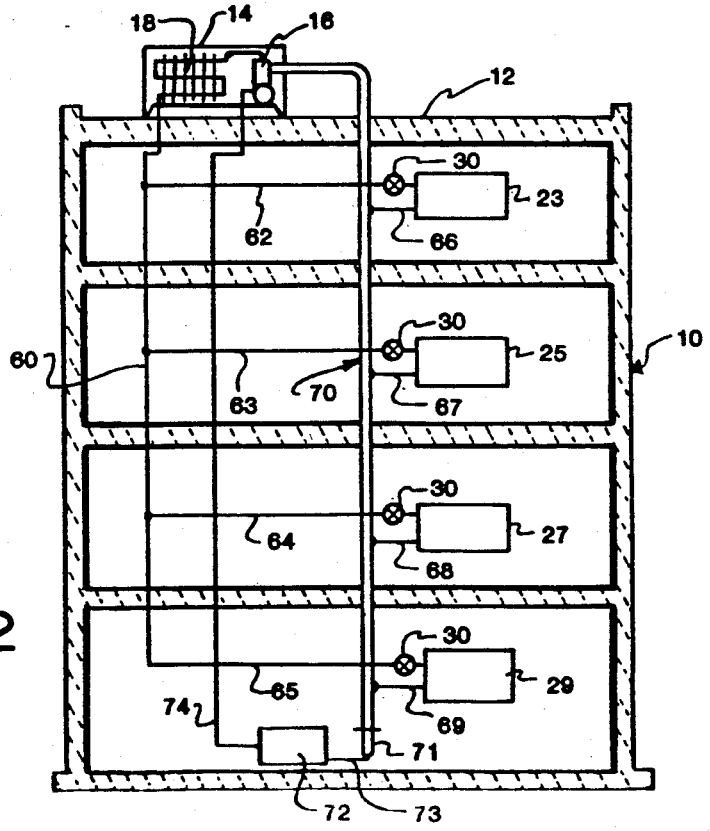
FIG. 2 is a schematic diagram of a direct expansion vapor-compression air conditioning system for a multi-story building in accordance with the present invention.

Referring to FIG. 2 of the drawings, there is illustrated in schematic form the building 10 in which the refrigeration system illustrated in FIG. 1 has been replaced by an improved system including a compressor/condenser unit 14 and the respective evaporators 23, 25, 27 and 29. The compressor/condenser unit 14 includes compressor 16 and air cooled condenser unit 18. Those skilled in the art will appreciate that the compressor/condenser unit 14 may include multiple compressors discharging into a manifold in communication with a common condenser, such as the condenser 18, or there may be provided a series of individual compressor and condenser units wherein the condensers are discharging into a common manifold, conducting liquid refrigerant to a liquid refrigerant supply line 60. In the schematic diagram of FIG. 2, the liquid refrigerant flow or supply line 60 is connected to the condenser 18 as illustrated. In the interest of clarity and conciseness, only a single compressor/condenser unit is illustrated in the diagram of FIG. 2. The common liquid refrigerant supply line 60 is connected to individual refrigerant supply conduits 62, 63, 64 and 65 leading to the respective evaporator units 23, 25, 27 and 29. Each of the refrigerant supply conduits 62 through 65 are provided with an expansion valve 30. As with the system of FIG. 1, the system illustrated in FIG. 2 may be provided with suitable temperature controls on each building floor level for operating the system in accordance with the requirements of the load on each of the evaporator units 23, 25, 27 and 29.

Each of the evaporator units of the system illustrated in FIG. 2 is provided, respectively, with a refrigerant vapor return line indicated by the numerals 66, 67, 68 and 69. All of the return lines are connected to a common refrigerant vapor return conduit or riser, generally designated by the numeral 70. The riser 70 differs substantially from the arrangement illustrated in FIG. 1. It is characterized by a single, generally vertical, conduit which is devoid of the complex fittings required to form the oil traps of the prior art system. Accordingly, lubricating oil circulating through the evaporators 23, 25, 27 and 29 and flowing through the return lines 66, 67, 68 and 69 will, upon entering the riser 70, flow generally vertically downward through the riser to collect in a reservoir or sump portion designated by the numeral 71 in FIG. 2. The reservoir portion 71 may simply be the lower closed end of the riser conduit 70 or the reservoir may be an enlarged vessel provided in accordance with the amount of oil that a particular system might require to be recirculated.

The oil, which will flow generally downwardly in the riser 70 due to a relatively low flow velocity of the refrigerant vapor returning to the compressor inlet, will accumulate in the resevoir 71 until a predetermined level is reached and then will be recirculated back to the compressor by way of a motor driven oil pump unit, generally designated by the numeral 72 in FIG. 2. The pump unit 72 includes a suction or inlet line 73 connected to the reservoir portion 71 and a discharge conduit 74 leading to the compressor 16. The oil discharge flow line 74 may be connected to a suitable inlet fitting in the compressor crankcase/oil sump or connected directly to the refrigerant vapor inlet line at the compressor.

Figure 3:
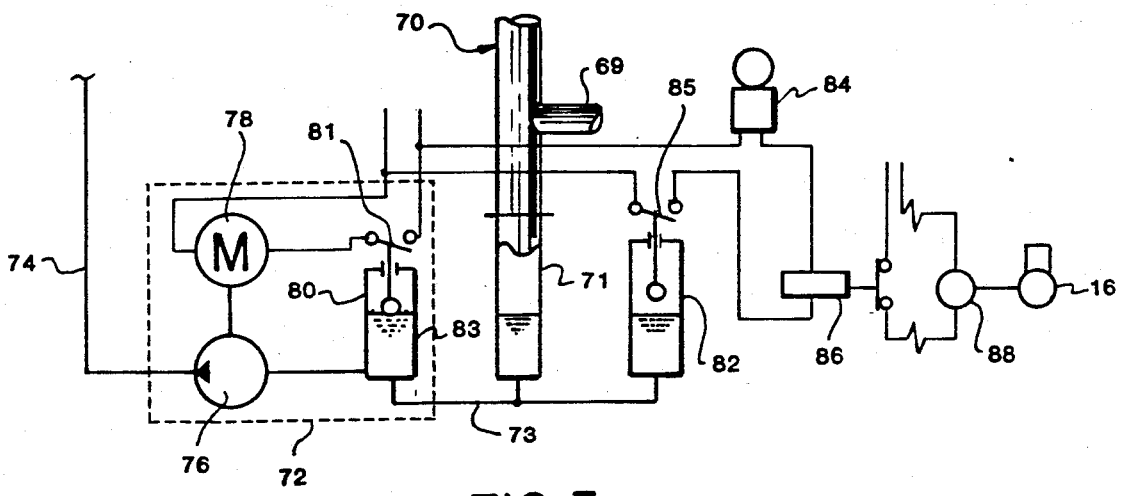
FIG. 3 is a schematic diagram showing details of the oil return system for the air conditioning system illustrated in FIG. 2.

Referring now to FIG. 3, a schematic diagram of the pump unit 72 is illustrated with a portion of the refrigerant flow return riser and with additional controls in accordance with the present invention. The pump unit 72 includes a positive displacement pump illustrated in schematic form and designated by the numeral 76. The pump 76 may be one of several types and may typically be a relatively small gear type pump having a displacement of approximately 0.5 to 2.0 gpm. The pump 76 is adapted to be driven by an electric motor 78 at a constant speed. The motor 78 is arranged to be energized by a liquid level sensing device 80, illustrated schematically in the drawing figures, which may comprise a closed pressure vessel 83 connected to the reservoir portion 71 of the return riser 70 and having a liquid level sensing switch 81 adapted to close on rising level of oil in the reservoir and the pressure vessel to energize the motor to pump oil out of the riser and through the return oil conduit 74.

A typical air conditionting system for each floor level of a building of seven floor levels and twenty thousand square feet per floor level of air conditioned space employs a vapor-compression type direct expansion air conditioning system of 720,000 btu/hr. capacity per floor. The per floor air conditioning system consists, in general, of an air handling unit with motor-pump unit located on the floor it serves coupled with its roof mounted compressor/condensing unit. It has been determined to require a motor-pump unit wherein the motor 78 is of a nominal rated 0.25 horsepower and the pump 76 has a 0.50 gpm delivery rate. For a typical installation as described above, the return oil conduit riser 74 is a tubular conduit of a nominal ⅜ inches diameter. Although those skilled in the art will recognize that the pump power and displacement requirements will vary in accordance with the size of the system, it will be appreciated that the power requirements for the separate motor-pump unit 72 are nominal as compared with the sizing of the air conditioning system including the compressor 16 which would be required if the complex refrigerant vapor return riser such as that illustrated in FIG. 1 were required as a means of returning system lubricating oil to the compressor. Moreover, the overall vertical elevation of the system from the reservoir 71 to the location of the compressor 16 will, of course, also dictate the power requirements for the pump unit 72. The motor 78 may be conveniently connected to a source of electric energy by connecting the leads shown in the schematic diagram of FIG. 3 into the building electrical system.

As illustrated in FIG. 3, the system for returning lubricating oil to the compressor 16 may also include secondary controls including a second liquid level sensing device 82, similar to the device 80, and which would normally be set to close a switch 85 at a higher level of oil in the reservoir 71 than that which closes the switch 81. The level sensing devices 80 and 82 may comprise devices which are commercially available and one source of a device as described herein is a model LLS float switch unit manufactured by Refrigerant Specialties Company, Broadview, Ill. In the event that the oil level in the reservoir 71 reaches an excessive level, the level sensing device 82 closes switch 85 which activates; (1) a relay 86 which opens the circuit to drive motor 88 for the compressor 16 and (2) an audible high oil level warning device 84.

Figure 4:
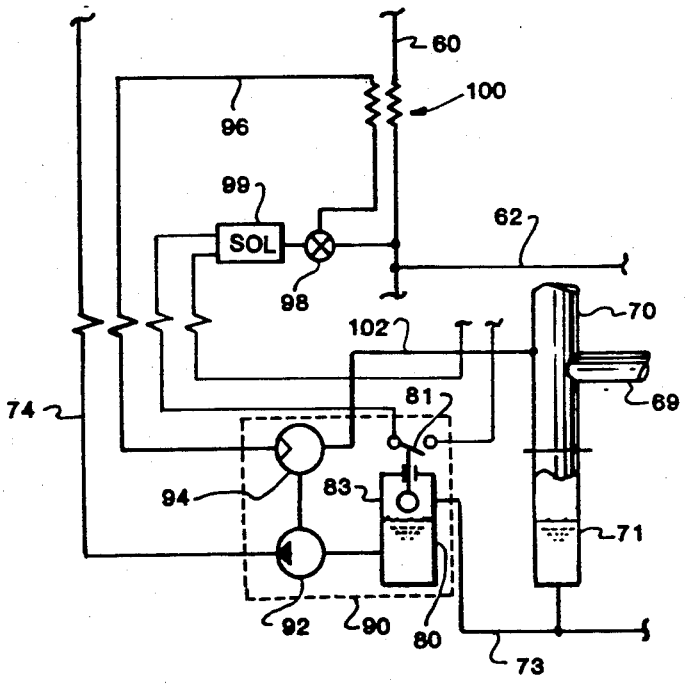
FIG. 4 is a schematic diagram of an alternate embodiment of an oil return system for the air conditioning system illustrated in FIG. 2.

An alternate embodiment of a pump unit for pumping refrigerant system oil back to the compressor is illustrated by the schematic diagram of FIG. 4. Referring to FIG. 4, a portion of the refrigerant vapor return riser 70, including the oil reservoir 71, is illustrated with a portion of the liquid refrigerant delivery system, including the conduit 60 leading from the condenser unit 18 illustrated in FIG. 2. FIG. 4 also illustrates a modified motor driven oil pump unit, generally designated by the numeral 90, which includes a pump 92 similar to the pump 76 and adapted to be driven by a fluid motor indicated schematically and designated by the numeral 94. The fluid motor 94 is arranged to receive high pressure refrigerant, preferably in vapor form, through a conduit 96 which is connected to the liquid refrigerant supply conduit 60 by way of a solenoid operated valve 98. The conduit 96 includes a portion which is in heat exchange relation with the conduit 60, as provided by suitable heat exchanger means designated by numeral 100, whereby the enthalpy of the refrigerant vapor flowing through the conduit 96 may be increased for energizing the motor 94. Exhaust fluid from the motor 94 is returned directly to the refrigerant riser 70 by way of a conduit 102.

In the oil pump arrangement illustrated in FIG. 4, the device 80, including the liquid level sensing switch 81, is connected in a suitable electrical circuit including a solenoid actuator 99 for the valve 98. Accordingly, on sensing a predetermined level of oil in the reservoir portion 71, switch 81 would close to energize the solenoid 99 for opening valve 98 to permit high pressure refrigerant fluid to be conducted to the motor 94 to drive the pump 92 so as to maintain a minimum accumulation of oil in the reservoir and provide for returning oil to the compressor by way of conduit 74. As illustrated in FIG. 4, the location of the tap off point for the supply conduit feeding solenoid valve 98 would normally be between the system condenser and the lowest refrigerant supply conduit 65 leading to an evaporator unit, such as the evaporator 29, so that regardless of which of the evaporator units was operating in a multiple evaporator system, the pump unit 90 would be assured of a supply of motive fluid for pumping oil from the return riser 70.

Figure 5:
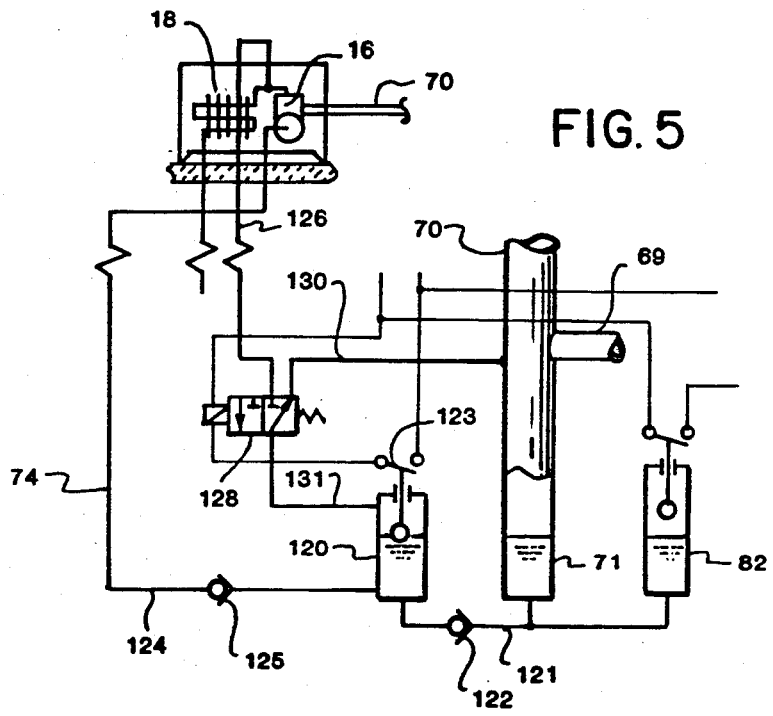
FIG. 5 is a schematic diagram of a second alternate embodiment of the present invention.

A second alternate embodiment of the oil collection and recirculation system of the present invention is illustrated in FIG. 5 in schematic form. Referring to FIG. 5, the reservoir portion 71 of the return riser 70 is illustrated as being connected to a closed pressure vessel, generally designated by the numeral 120, by way of a conduit 121 having interposed therein a check valve 122. The pressure vessel 120 may include single or dual liquid level sensing switch devices similar to the aforementioned switch 81 and generally designated by the numeral 123. In the schematic illustration of FIG. 5, the pressure vessel 120 is illustrated as including only the single liquid level sensing switch 123 although the liquid level sensing device 82 could be combined into the pressure vessel 120. An alternate arrangement as described herein could be utilized by providing a unit which is commercially available. One source of a dual liquid level sensing switch is manufactured by BEC Controls Corp., Davenport, Iowa as their model S-205-12. The representation of the pressure vessel 120 is for illustration purposes only and it will be understood that the pressure vessel is adapted to operate with fluid pressures above or below ambient atmospheric pressure and to not leak to the atmosphere. The pressure vessel 120 is connected to the separate oil return conduit 74 by a conduit portion 124 having a check valve 125 interposed therein.

The arrangement illustrated in FIG. 5 includes a conduit 126 which is in communication with the hot gas discharge line of the compressor 16. The conduit 126 is connected into the compressor discharge line between the compressor 16 and the condenser unit 18 as illustrated. The hot gas conduit 126 is connected to a suitable solenoid valve generally designated by the numeral 128. Solenoid 128 is arranged in an electrical circuit including the switch 123. When the switch 123 is in an open position, the valve 128 is in a position to connect the interior of the pressure vessel 120 in fluid communication with the return riser 70 by way of a conduit portion 130 so that the fluid pressure within the interior of the pressure vessel is substantially the same as the fluid pressure in the return riser 70 including its liquid reservoir portion 71. As the liquid level increases in the pressure vessel 120 corresponding to that in the return riser 70, the switch 123 will close shifting the valve 128 to a position which will permit high pressure refrigerant vapor to flow through the conduit 126 and conduit 131 into the interior of the pressure vessel 120 to force oil out through check valve 125, conduit 124, and through the oil return conduit 74 back to the compressor 16. Oil is prevented from flowing back into the return riser reservoir portion 71 by the check valve 122.

When the liquid level in the pressure vessel 120 is reduced, the switch 123 is opened and the valve 128 is shifted back to a position which places the interior of the pressure vessel 120 at the same fluid pressure as the return riser 70 whereby oil may again accumulate in the interior of the pressure vessel until a predetermined liquid level is reached. If the oil pumping system illustrated in FIG. 5 should malfunction in any manner, the increasing level of oil in the reservoir portion 71 will be detected by the liquid level sensing device 82 to effect a warning signal and/or shut down of the refrigeration system in accordance with the arrangement described in the embodiments illustrated in FIGS. 3 and 4 of the drawings. In all of the arrangements illustrated herein, the return riser reservoir portion 71 could be replaced by a suitable separate vessel such as the pressure vessel 120.

Figure 6:
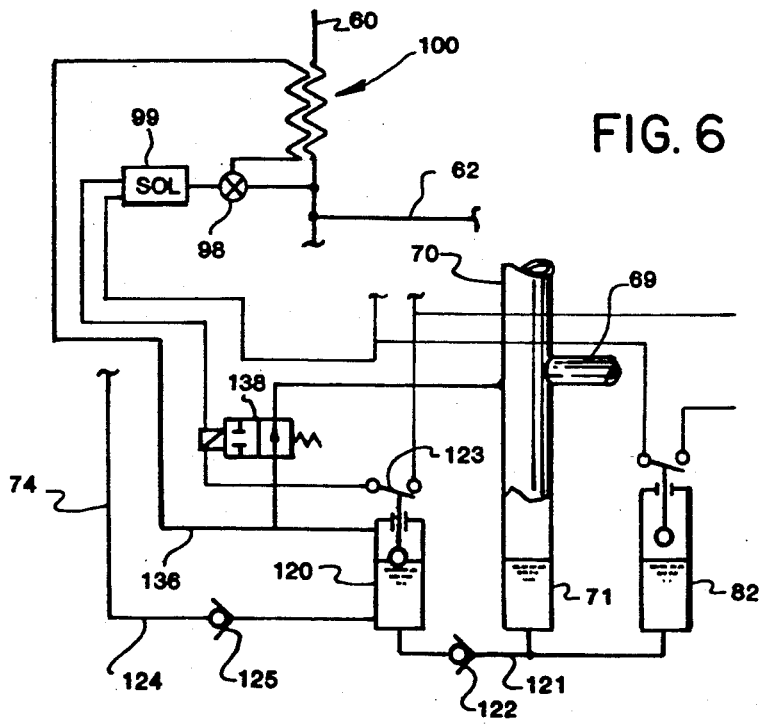
FIG. 6 is a schematic diagram of a third alternate embodiment of the present invention.

A third alternate embodiment of the present invention is illustrated schematically in the diagram of FIG. 6. The arrangement illustrated in FIG. 6 is similar in some respects to the system of FIG. 5 in that high pressure refrigerant vapor is used to pump oil through the separate oil return conduit 74 to prevent excess accumulation of oil in the reservoir portion 71 and the pressure vessel 120. The arrangement illustrated in FIG. 6 preferably utilizes a liquid level sensing unit including the pressure vessel 120 and the liquid level sensing switch 123. The pressure vessel 120 is in communication with the return riser conduit by way of flow line 121 and check valve 122. Moreover, the oil return conduit portion 124 has in series with it the check valve 125. In the system of FIG. 6, high pressure refrigerant vapor is provided by way of a conduit 136 leading to the pressure vessel 120 and connected to a solenoid operated expansion valve 98 similar to the arrangement illustrated in FIG. 4. The system illustrated in FIG. 6 also includes a solenoid operated vent valve 138 arranged to be in communication with the interior of the pressure vessel 120 for reducing the fluid pressure within the interior of the pressure vessel by connecting it with the refrigerant vapor return riser 70. In the arrangement illustrated in FIG. 6, when a predetermined oil level is sensed by the liquid level sensing switch 123, the switch closes, which shifts the solenoid valve 138 to a closed position and opens the expansion valve 98. This allows liquid refrigerant from the liquid refrigerant supply line 60 to flow through the heat exchanger section 100, thereby causing the liquid refrigerant to quickly vaporize at a pressure greater than the pressure in the refrigerant vapor return circuit and to flow to the interior of the pressure vessel 120 to rapidly displace oil through the return conduit 124-74. When a reduced oil level in the interior of the pressure vessel 120 is sensed by the switch 123, the switch opens to thereby close the valve 98 which allows the valve 138 to shift to a position which equalizes the pressure in the interior of the pressure vessel 120 with the pressure in the interior of the refrigerant vapor return riser 70. Oil may again flow from the base of the riser 70 into the pressure vessel 120 and accumulate until the level sensing switch 123 closes to repeat the above described operating cycle.

Although preferred embodiments of the present invention have been illustrated schematically in the accompanying drawings and described in sufficient detail to enable one skilled in the art to practice the invention, it will be appreciated that certain modifications and substitutions may be made to the system disclosed herein without departing from the scope and spirit of the invention as recited in the appended claims.

What we claim is:

1. In a vapor-compression refrigeration system:

an oil lubricated compressor, a condenser and an evaporator interconnected by conduit means to form a closed circuit for circulation of a refrigerant fluid;

at least part of said conduit means comprising a refrigerant vapor return conduit for conducting refrigerant vapor from said evaporator to said compressor, said compressor being disposed at a vertical elevation above said evaporator;

reservoir means in fluid flow communication with said refrigerant vapor return conduit for collecting oil separated from said refrigerant fluid;

means for pumping oil from said reservoir means to said compressor through a separate oil return conduit;

a fluid operated motor adapted to be driven by refrigerant fluid from said refrigeration system, said motor driving said pumping means; and control means, including first liquid level sensing means, for sensing a predetermined accumulation of oil in said reservoir means and causing said pumping means to be energized to pump oil from said reservoir means to said compressor;

said first liquid level sensing means including switch means interposed in a control circuit and operable to cause said control circuit to energize said pumping means;

said control circuit adapted to open and close a refrigerant flow control valve for controlling the flow of refrigerant fluid through said fluid operated motor, said control circuit further being operable to energize and deenergize said motor to prevent more than a predetermined quantity of oil from accumulating in said reservoir means.

2. The system set forth in claim 1 wherein:

said motor is interposed in a refrigerant fluid circuit including a supply conduit in communication with a portion of said conduit means for conducting liquid refrigerant from said condenser to expansion valve means for said evaporator, and said flow control valve is interposed in said supply conduit upstream of said motor for controlling the flow of said refrigerant fluid to said motor.

3. The system set forth in claim 2 wherein:

said flow control valve includes oeprator means in circuit with said switch means and operable to open said flow control valve to permit flow of refrigerant fluid to said motor when oil accumulates to a predetermined level in said reservoir means.

4. The system set forth in claim 2 wherein:

said refrigerant fluid circuit includes a conduit in communication with said motor and said refrigerant vapor return conduit for conducting refrigerant fluid from said motor to said refrigerant vapor return conduit.

5. In a vapor-compression refrigeration system:

an oil lubricated compressor, a condenser and evaporator interconnected by conduit means to form a closed circuit for circulation of a refrigerant fluid;

at least part of said conduit means comprising a refrigerant vapor return conduit for conducting refrigerant vapor from said evaporator to said compressor, said compressor being disposed at a vertical elevation from said evaporator;

reservoir means in fluid flow communication with said refrigerant vapor return conduit for collecting oil separated from said refrigerant fluid;

means, including a fluid operated motor and a pump driven by said motor, for pumping oil from said reservoir means to said compressor through a separate oil return conduit; and control means, including first liquid level sensing means, for sensing a predetermined accumulation of oil in said reservoir means and causing said pumping means to be energized to pump oil from said reservoir means to said compressor;

said first liquid level sensing means includes switch means interposed in a control circuit and operable to cause said control circuit to energize and deenergize said motor to prevent more than a predetermined quantity of oil from accumulating in said reservoir means.

6. The system as set forth in claim 5 wherein said fluid operated motor is adapted to be driven by refrigerant fluid and wherein said control circuit is adapted to open and close a refrigerant flow control valve for controlling the flow of refrigerant flow through said fluid operated motor.

7. A vapor-compression air conditioning system for a multi-story building comprising:

(a) a plurality of evaporator units vertically separated from each other;

(b) condenser means;

(c) oil lubricated compressor means disposed at a vertical elevation above said plurality of evaporator units;

(d) conduit means interconnecting said plurality of evaporator units, condenser means and compressor means to form a closed circuit, said conduit means comprising a straight-line and generally vertical vapor refrigerant return conduit for conducting only vapor refrigerant from said plurality of evaporator units to said compressor means, said vapor refrigerant return conduit having no trap means therein;

(e) separating means for separating lubricant oil from fluid refrigerant as said fluid refrigerant with said lubricant oil entrained therein exits each of said plurality of evaporator units, said separating means comprising reservoir means disposed at a vertical elevation below said vapor refrigerant return conduit and communicating with said vapor refrigerant return conduit for separating and collecting said lubricant oil therein from said vapor refrigerant return conduit;

(f) a lubricant oil return line for conduting lubricant oil from said reservoir means to said compressor means;

(g) pump means, comprising a fluid pump driven by a fluid motor, for pumping said lubricant oil through said oil return line from said reservoir means to said compressor means;

(h) a first liquid level sensing means disposed within said reservoir means for sensing the level of liquid within said reservoir means; and (i) switch means coupled to said first liquid level sensing means for actuating said pump means to pump said lubricant oil from said reservoir means to said compressor means, said switch means being responsive to the level of said liquid within said reservoir means reaching a predetermined maximum level.

* * * * *